US011428113B2

(12) United States Patent
Ganiger et al.

(10) Patent No.: US 11,428,113 B2
(45) Date of Patent: Aug. 30, 2022

(54) VARIABLE STATOR VANES WITH ANTI-LOCK TRUNNIONS

(71) Applicant: GENERAL ELECTRIC COMPANY, Schenectady, NY (US)

(72) Inventors: Ravindra Shankar Ganiger, Bengaluru (IN); Kevin Lee Kirkeng, Milford, OH (US); Vishnu Das K, Bengaluru (IN); Reddi Hari Prasad Reddy Mylapalli, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/115,366

(22) Filed: Dec. 8, 2020

(65) Prior Publication Data

US 2022/0178270 A1 Jun. 9, 2022

(51) Int. Cl.

| | |
|---|---|
| ***F01D 17/16*** | (2006.01) |
| *F01D 9/04* | (2006.01) |
| *F01D 25/24* | (2006.01) |
| *F04D 29/56* | (2006.01) |

(52) U.S. Cl.

CPC ..... *F01D 17/16* (2013.01); *F01D 9/042* (2013.01); *F01D 17/162* (2013.01); *F01D 25/246* (2013.01); *F04D 29/563* (2013.01); *F05D 2220/32* (2013.01); *F05D 2240/12* (2013.01); *F05D 2240/128* (2013.01); *F05D 2250/241* (2013.01)

(58) Field of Classification Search

CPC ..... F01D 17/162; F01D 9/041; F01D 9/042; F04D 29/563; F05D 2240/12

See application file for complete search history.

(56) References Cited

U.S. PATENT DOCUMENTS

| | | | | |
|---|---|---|---|---|
| 2,124,034 A | | 7/1938 | Hufferd | |
| 2,924,375 A | | 2/1960 | McKissock | |
| 2,972,441 A | * | 2/1961 | Russells | F01D 17/162 415/149.4 |
| 3,075,744 A | * | 1/1963 | Peterson | F01D 5/189 415/115 |
| 3,325,087 A | * | 6/1967 | Davis | F04D 29/563 415/209.3 |
| 3,904,309 A | | 9/1975 | Keetley | |
| 3,990,810 A | | 11/1976 | Amos et al. | |
| 4,013,377 A | * | 3/1977 | Amos | F01D 17/162 415/161 |
| 4,086,042 A | * | 4/1978 | Young | F01C 21/0881 418/139 |
| 8,147,187 B2 | * | 4/2012 | Foucher | F01D 17/162 415/155 |
| 9,273,565 B2 | * | 3/2016 | Propheter-Hinckley | F01D 9/041 |

(Continued)

*Primary Examiner* — Woody A Lee, Jr.
*Assistant Examiner* — Behnoush Haghighian
(74) *Attorney, Agent, or Firm* — Hanley, Flight & Zimmerman, LLC

(57) ABSTRACT

Variable stator vanes with anti-lock trunnions are disclosed. An example apparatus disclosed herein includes an airfoil to be disposed within a flow path of a gas turbine engine, the gas turbine engine defining an axial axis, a radial axis and a circumferential axis, an outer trunnion, and an inner trunnion including a curved surface in an axial-radial plane, the inner trunnion enabling the airfoil to be rotatably mounted to an inner shroud of the gas turbine engine.

20 Claims, 7 Drawing Sheets

(56) References Cited

U.S. PATENT DOCUMENTS

| | | | | |
|---|---|---|---|---|
| 9,670,877 | B2 * | 6/2017 | Sawyers-Abbott | F02K 1/763 |
| 10,294,814 | B2 * | 5/2019 | Wulf | F02B 37/24 |
| 10,502,090 | B2 * | 12/2019 | Betancourt | F01D 25/24 |
| 10,711,632 | B2 * | 7/2020 | Snider | F01D 25/246 |
| 10,746,057 | B2 * | 8/2020 | Snider | F01D 25/246 |
| 2008/0206045 | A1 * | 8/2008 | Foucher | F01D 17/162 415/160 |
| 2013/0216361 | A1 * | 8/2013 | Propheter-Hinckley | F01D 9/041 415/160 |
| 2016/0160874 | A1 * | 6/2016 | Lamicq | F04D 27/0246 415/208.1 |
| 2017/0159467 | A1 * | 6/2017 | Albers | F01D 9/041 |
| 2018/0119567 | A1 * | 5/2018 | Wulf | F04D 29/563 |
| 2019/0093491 | A1 * | 3/2019 | O'Neill | F01D 9/00 |
| 2020/0072073 | A1 * | 3/2020 | Snider | F04D 29/563 |
| 2020/0072086 | A1 * | 3/2020 | Snider | F01D 25/246 |

* cited by examiner

VARIABLE STATOR VANES WITH ANTI-LOCK TRUNNIONS

FIELD OF THE INVENTION

The present disclosure relates generally to variable stator vanes and, more particularly, to variable stator vanes with anti-lock trunnions.

BACKGROUND OF THE INVENTION

A gas turbine engine generally includes, in serial flow order, an inlet section, a compressor section, a combustion section, a turbine section, and an exhaust section. In operation, air enters the inlet section and flows to the compressor section, where one or more axial compressors progressively compress the air until it reaches the combustion section. Fuel mixes with the compressed air and burns within the combustion section, thereby creating combustion gases. The combustion gases flow from the combustion section through a hot gas path defined within the turbine section and then exit the turbine section via the exhaust section.

Gas turbine engines generally include stator vanes, which redirect air flowing therethrough to ensure air is approaching the rotating airfoils of the gas turbine engine at an optimal angle. Variable stator vanes (VSV) enable the angle of stator vanes to radially rotate during operation of the gas turbine. VSVs allow the dynamic adjustment of the stator blade orientation to ensure optimal air inlet angle on the rotor blades at all operating conditions. Additionally, variable stator vanes protect against stall/surge conditions by enabling dynamic adjustment of the flow rate through the compressor via the VSVs. Generally, VSVs increase the aerodynamic stability of the compressor and improve engine performance at off-design speeds.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
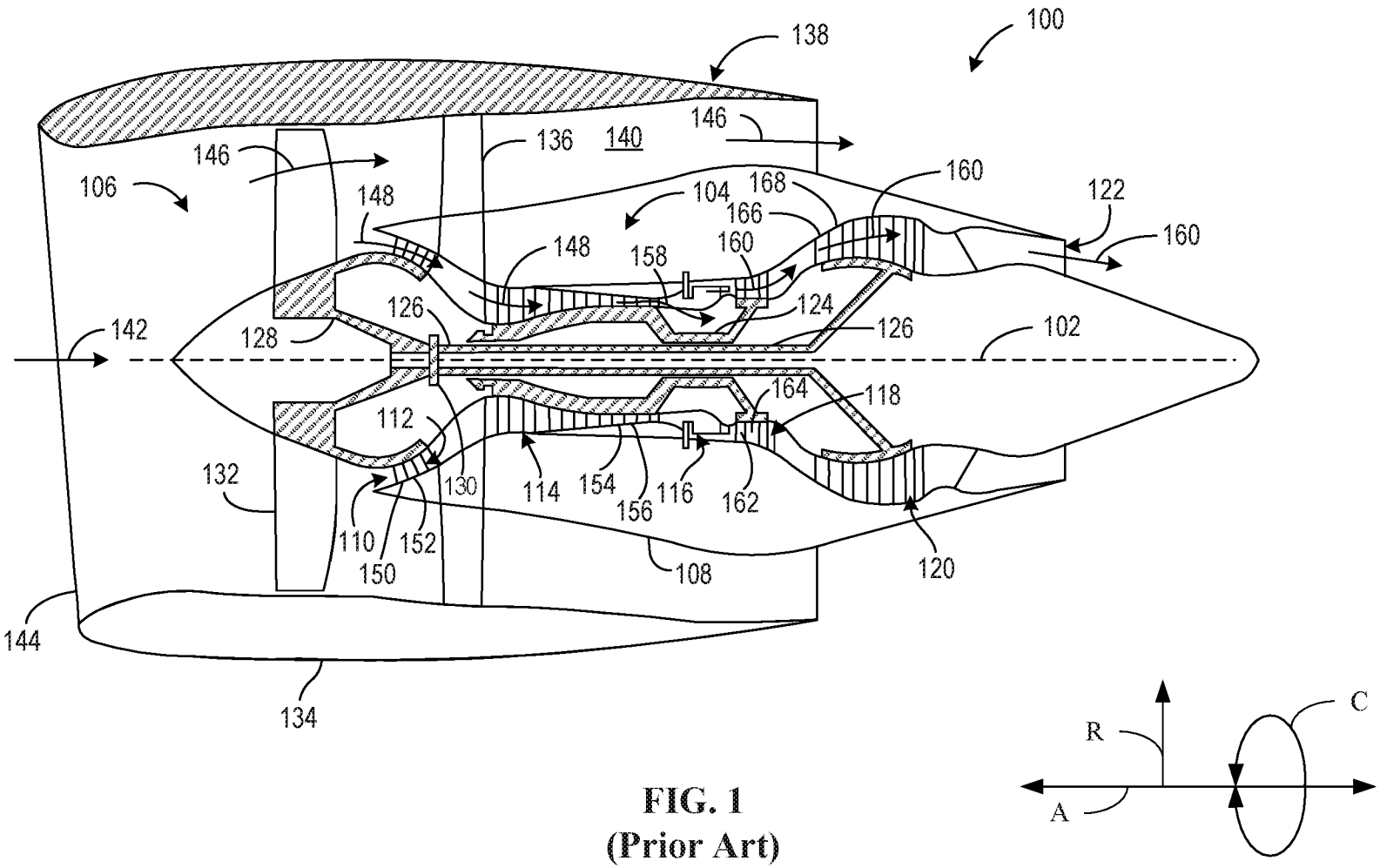
FIG. 1 (Prior Art)
FIG. 1 is a schematic cross-sectional view of a gas turbine engine in which the teachings of this disclosure may be implemented.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., section, linkage, area, region, or plate, etc.) is in any way on (e.g., positioned on, located on, disposed on, disposed about, or formed on, etc.) another part, indicates that the referenced part is either in contact with the other part, or that the referenced part is above the other part with one or more intermediate part(s) located therebetween. Connection references (e.g., attached, coupled, mated, connected, joined, etc.) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts.

BRIEF SUMMARY

Aspects and advantages of the invention will be set forth in part in the following description, or may be obvious from the description, or may be learned through practice of the invention. In one aspect, the present disclosure is directed towards an apparatus. The apparatus disclosed herein includes an airfoil to be disposed within a flow path of a gas turbine engine, the gas turbine engine defining an axial axis, a radial axis and a circumferential axis, an outer trunnion, and an inner trunnion including a curved surface in an axial-radial plane, the inner trunnion enabling the airfoil to be rotatably mounted to an inner shroud of the gas turbine engine.

A further aspect of the disclosure is directed towards an apparatus to be coupled within a gas turbine engine, the gas turbine engine defining an axial axis, a radial axis and a circumferential axis. The apparatus includes an inner shroud segment, an outer shroud segment, a plurality of variable stator vanes (VSVs) extending between the inner shroud segment and the outer shroud segment. A first VSV of the plurality of VSVs includes an airfoil, an outer trunnion mounted within the outer shroud segment, and an inner trunnion mounted within the inner shroud segment, the inner trunnion including a curved surface in an axial-radial plane, the inner trunnion enabling the airfoil to be rotatably mounted to the inner shroud segment.

A further aspect of the disclosure is directed towards a gas turbine engine defining an axial axis, a radial axis, and a circumferential axis. The gas turbine engine includes an inner shroud, an airfoil to be disposed within a flow path of the gas turbine engine, an outer trunnion disposed at a top edge of the airfoil, and an inner trunnion including a curved surface in an axial-radial plane, the inner trunnion enabling the airfoil to be rotatably mounted to the inner shroud.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

DETAILED DESCRIPTION

Currently, many VSV and shroud assemblies include two 180° segments, which must maintain sufficient stiffness and durability when exposed to high vibrations. Many such prior art VSV and shroud assemblies experience cracking when exposed to high operational stresses and/or high vibration response modes (e.g., soldier mode response, etc.). As used herein, "soldier mode response" refers to a vibrational response where all VSV airfoils vibrate in unison. Particularly, certain vibrational responses can result in VSV locking (e.g., inhibition of VSV rotation, etc.), which can cause high operational stress and/or high vibration responses on the VSV. Examples disclosed herein include spherical and semi-spherical VSV inner trunnions, which delink operational deformations from vibration and/or stress inducing boundary condition(s). Such inner trunnions prevent VSV lock, reduce premature cracking, and reduce the mass of the VSV and shroud assembly.

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized. The following detailed description is therefore, provided to describe an exemplary implementation and not to be taken limiting on the scope of the subject matter described in this disclosure. Certain features from different aspects of the following description may be combined to form yet new aspects of the subject matter discussed below.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

The terms "upstream" and "downstream" refer to the relative direction with respect to fluid flow in a fluid pathway. For example, "upstream" refers to the direction from which the fluid flows, and "downstream" refers to the direction to which the fluid flows.

Various terms are used herein to describe the orientation of features. As used herein, the orientation of features, forces and moments are described with reference to the yaw axis, pitch axis, and roll axis of the vehicle associated with the features, forces and moments. In general, the attached figures are annotated with reference to the axial direction, radial direction, and circumferential direction of the gas turbine associated with the features, forces and moments. In general, the attached figures are annotated with a set of axes including the axial axis A, the radial axis R, and the circumferential axis C.

In some examples used herein, the term "substantially" is used to describe a relationship between two parts that is within three degrees of the stated relationship (e.g., a substantially colinear relationship is within three degrees of being linear, a substantially perpendicular relationship is within three degrees of being perpendicular, a substantially parallel relationship is within three degrees of being parallel, etc.). As used herein, an object is substantially specifically if the object has a radius that varies within 15% of the average radius of the object.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

VSVs allow individual stator vanes to rotate about their respective axes. In some current designs, VSV & shroud assemblies are composed of two 180 degree segments, which when assembled, form a single row of stators associated with a particular stage of a compressor of gas turbine. In some examples, the rotation of the VSVs is enabled/controlled by trunnions disposed within the inner and outer shrouds of the compressor. As used herein, a "trunnion" is part and/or feature that permits a rotation of the part and/or feature supported thereon and/or thereby. In some such current examples, the trunnions of the inner shroud are cylindrically shaped and can include retainer lips to retain the trunnion within the shroud and/or seal box. In some current designs, vibration response modes (e.g., a solder mode response, etc.), can cause fatigue and cracking in these cylindrical trunnions. For example, during particular vibration and/or thermal responses, the cylindrical shape of the trunnion may deform in matter that causes three points of the trunnion to contact the shroud, which prevents the trunnion from rotating, thereby locking the VSV. Additionally, trunnion locking can cause fatigue and cracking in the cylindrical trunnion.

Examples disclosed herein overcome the above noted deficiencies via spherical inner trunnions and inner trunnions with curved surfaces. In examples disclosed herein, VSVs with substantially spherical trunnions delink deformation and prevent VSV lock. In other examples disclosed herein, VSVs with curved surfaces delink deformation and prevent VSV lock. In some examples disclosed herein, the inner trunnions of a VSVs reduce and/or eliminate the locking of the VSV at the shroud split-line assembly. Examples disclosed herein enable split line end vane segments to rotate (e.g., roll, etc.) in response to shroud bending, which reduces stress on the outer trunnion. Examples disclosed herein offer significant weight reductions when compared to current inner trunnion designs, thereby decreasing material costs of the engine and increasing engine efficiency. Examples disclosed herein delink the deformations of the trunnions thereby increasing vane durability in response to bending and shear loads. Examples disclosed herein enable the inner trunnion to rub against the inner shroud and thereby act as a frictional damper. While examples disclosed herein are described with reference to stators in the compressor of a turbofan engine, the examples disclosed herein can be applied to stators in any section of any type of gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic cross-sectional view of a prior art turbofan-type gas turbine engine 100 ("turbofan 100"). As shown in FIG. 1, the turbofan 100 defines a longitudinal or axial centerline axis 102 extending therethrough for reference. In general, the turbofan 100 can include a core section 104 disposed downstream from a fan section 106.

The core section 104 generally includes a substantially tubular outer casing 108 that defines an annular inlet 110. The outer casing 108 can be formed from a single casing or multiple casings. The outer casing 108 encloses, in serial flow relationship, a compressor section having a booster or low pressure compressor 112 ("LP compressor 112") and a high pressure compressor 114 ("HP compressor 114"), a combustion section 116, a turbine section having a high pressure turbine 118 ("HP turbine 118") and a low pressure turbine 120 ("LP turbine 120"), and an exhaust section 122. A high pressure shaft or spool 124 ("HP shaft 124") drivingly couples the HP turbine 118 and the HP compressor 114. A low pressure shaft or spool 126 ("LP shaft 126") drivingly couples the LP turbine 120 and the LP compressor 112. The LP shaft 126 may also couple to a fan spool or shaft 128 of the fan section 106. In some examples, the LP shaft 126 may couple directly to the fan shaft 128 (e.g., a direct-drive configuration). In alternative configurations, the LP shaft 126 may couple to the fan shaft 128 via a reduction gear 130 (e.g., an indirect-drive or geared-drive configuration).

As shown in FIG. 1, the fan section 106 includes a plurality of fan blades 132 coupled to and extending radially outwardly from the fan shaft 128. An annular fan casing or nacelle 134 circumferentially encloses the fan section 106 and/or at least a portion of the core section 104. The nacelle 134 is supported relative to the core section 104 by a plurality of circumferentially-spaced apart outlet guide vanes 136. Furthermore, a downstream section 138 of the nacelle 134 can enclose an outer portion of the core section 104 to define a bypass airflow passage 140 therebetween.

As illustrated in FIG. 1, air 142 enters an inlet portion 144 of the turbofan 100 during operation thereof. A first portion 146 of the air 142 flows into the bypass flow passage 140, while a second portion 148 of the air 142 flows into the inlet 110 of the LP compressor 112. One or more sequential stages of LP compressor stator vanes 150 and LP compressor rotor blades 152 coupled to the LP shaft 126 progressively compress the second portion 148 of the air 142 flowing through the LP compressor 112 enroute to the HP compressor 114. Next, one or more sequential stages of HP compressor stator vanes 154 and HP compressor rotor blades 156 coupled to the HP shaft 124 further compress the second portion 148 of the air 142 flowing through the HP compressor 114. This provides compressed air 158 to the combustion section 116 where it mixes with fuel and burns to provide combustion gases 160.

The combustion gases 160 flow through the HP turbine 118 in which one or more sequential stages of HP turbine stator vanes 162 and HP turbine rotor blades 164 coupled to the HP shaft 124 extract a first portion of kinetic and/or thermal energy from the combustion gases 160. This energy extraction supports operation of the HP compressor 114. The combustion gases 160 then flow through the LP turbine 120 where one or more sequential stages of LP turbine stator vanes 166 and LP turbine rotor blades 168 coupled to the LP shaft 126 extract a second portion of thermal and/or kinetic energy therefrom. This energy extraction causes the LP shaft 126 to rotate, thereby supporting operation of the LP compressor 112 and/or rotation of the fan shaft 128. The combustion gases 160 then exit the core section 104 through the exhaust section 122 thereof.

Along with the turbofan 100, the core section 104 serves a similar purpose and sees a similar environment in land-based gas turbines, turbojet engines in which the ratio of the first portion 146 of the air 142 to the second portion 148 of the air 142 is less than that of a turbofan, and unducted fan engines in which the fan section 106 is devoid of the nacelle 134. In each of the turbofan, turbojet, and unducted engines, a speed reduction device (e.g., the reduction gearbox 130) may be included between any shafts and spools. For example, the reduction gearbox 130 can be disposed between the LP shaft 126 and the fan shaft 128 of the fan section 106.

Figure 2:
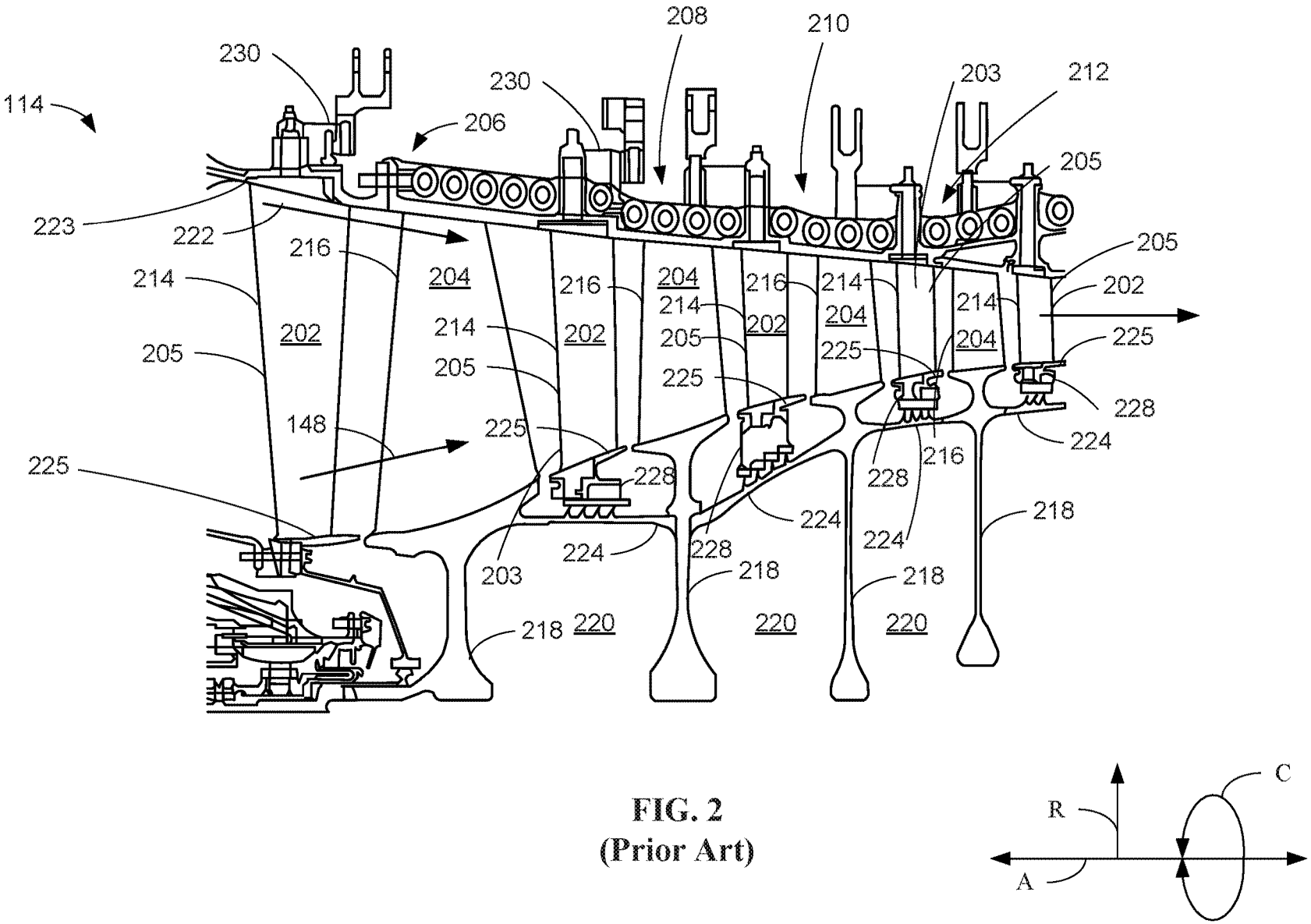
FIG. 2 (Prior Art)
FIG. 2 is a staging diagram including a prior art VSV within the flow path of a prior art compressor.

FIG. 2 illustrates an example cross-sectional side view of the HP compressor 114 of the turbofan 100 shown in FIG. 1. The HP compressor 114 includes one or more sequential stages. The illustrated example of FIG. 2 includes a first stage 206, a second stage 208 positioned axially downstream from the first stage 206, a third stage 210 positioned axially downstream from the second stage 208, and a fourth stage 212 positioned axially downstream from the third stage 210. Although, the HP compressor 114 can include more or fewer stages as is necessary or desired.

Each of the stages 206, 208, 210, 212 includes a row 214 of the stator vanes 202 and a row 216 of the rotor blades 204. The stator vanes 202 in the row 214 are circumferentially spaced apart. In FIG. 2, the stator vanes 202 are variable stator vanes ("VSVs") and include an example prior art VSV 203. The prior art VSV 203 includes a stator airfoil 205 (hereafter "airfoil") and a level arm 230. The VSV 203 is disposed above a seal box 228 and is coupled to a VSV lever arm 230. The lever arm 230 articulates rotation of the prior art VSV 203 about the radial axis R.

The rotor blades 204 in the row 216 are also circumferentially spaced apart. In the example shown in FIG. 2, the row 216 of rotor blades 204 is positioned axially downstream from the row 214 of stator vanes 202. Each of the rotor blades 204 includes a connection portion extending radially inwardly therefrom for coupling with a corresponding rotor disc 218. The connection portion may be an axial dovetail, a circumferential dovetail, a fir tree, or any other suitable connection portion shape.

The rows 214 of the stator vanes 202 and the rows 216 of the rotor blades 204 of each of the stages 206, 208, 210, 212 collectively define a compressed gas path 222 through which the second portion 148 of the air 142 flows. The compressed gas path 222 is defined by an outer shroud 223 and inner shroud 225. In particular, the stator vanes 202 direct the second portion 148 of the air 142 onto the rotor blades 204, which impart kinetic energy into the second portion 148 of the air 142. In this respect, the rotor blades 204 convert the second portion 148 of the air 142 flowing through the HP compressor 114 into the compressed air 158. Outlet guide vanes, if included, direct the flow of compressed air 158 into the combustion section 116.

A coupling, such as a labyrinth seal 224, is positioned between each adjacent pair of rotor discs 218. In the example shown in FIG. 2, for example, a first labyrinth seal 224 is positioned between the rotor discs 218 of the first and the second stages 206, 208. A second labyrinth seal 224 is positioned between the rotor discs 218 of the second and the third stages 208, 210. A third labyrinth seal 224 is positioned between the rotor discs 218 of the third and the fourth stages 210, 212. A fourth labyrinth seal 224 is positioned axially downstream of the rotor discs 218 of the fourth stage 212. The labyrinth seals 224 prevent interstage leakage of the second portion 148 of the air 142 across the compressor stages 206, 208, 210, 212. Furthermore, the labyrinth seals 224 permit relative rotation between each of the rows 214 of stator vanes 202 and the adjacent rotor discs 218. This allows the rotor blades 204 to rotate, while the stator vanes 202 remain stationary. In other examples, the coupling can include a brush seal (not shown) or other seal(s). In this respect, all of the rotor discs 218 rotate in unison when the HP turbine 118 drives the HP shaft 124. Furthermore, each of the labyrinth seals 224 in combination with each corresponding adjacent pair of rotor discs 218 coupled thereby define a rotor disc space 220.

Figure 3B:
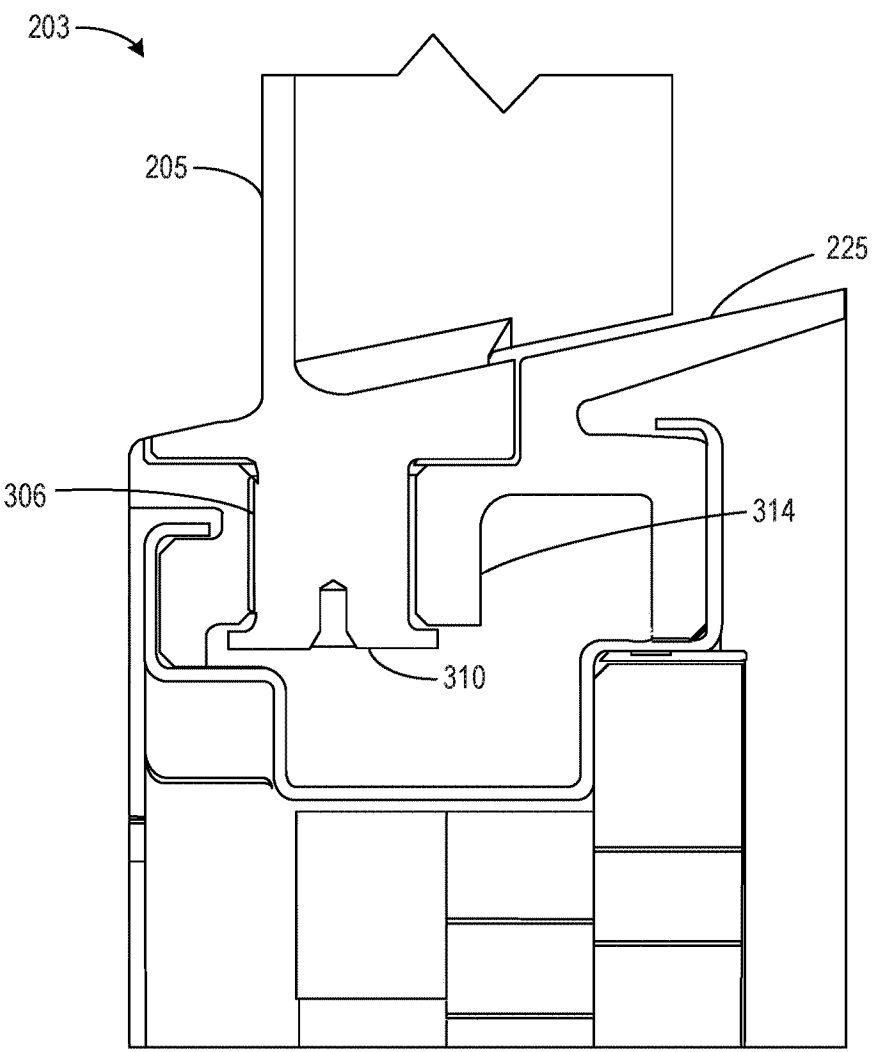
FIG. 3B (Prior Art)
FIG. 3B is a cross-sectional view of the prior art VSV of FIGS. 2 and 3A coupled within a prior art shroud.
Figure 3A:
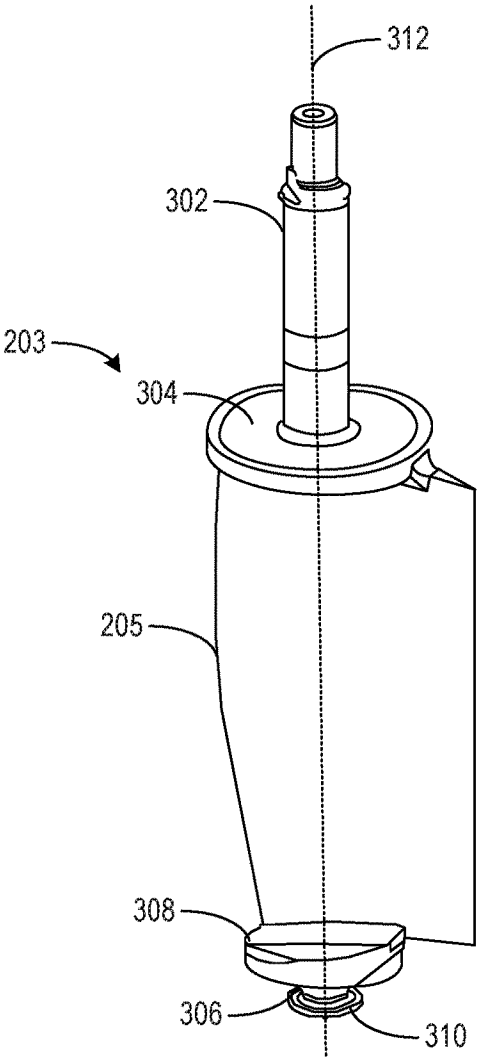
FIG. 3A (Prior Art)
FIG. 3A is a perspective view of the prior art VSV of FIG. 2.

FIG. 3A is a perspective view of a prior art VSV 203 of FIG. 2. In FIG. 3A, the prior art VSV 203 includes an outer trunnion 302, which is configured to be disposed within the outer shroud 223. The outer trunnion 302 extends radially outward from the outer platform 304 into the outer shroud 223. The prior art VSV 203 includes a prior art inner trunnion 306, which is configured to be disposed within the inner shroud 225. The inner trunnion 306 extends radially inward from an inner platform 308 into the inner shroud 225. In the illustrated example of FIG. 3A, the inner trunnion 306 includes a retainer lip 310.

During operation, the outer trunnion 302 is pivotably coupled to the lever arm 230 of FIG. 2. As the lever arm 230 actuates (e.g., based an engine speed, a stall condition, a surge condition, etc.), the VSV 203 rotates about an axis 312 to control the angle of incidence of the second portion 148 of the air onto the stator airfoil 205 and the air inlet angle on the rotor airfoil 204.

FIG. 3B is a cross-sectional view of the prior art VSV 203 of FIGS. 2 and 3A coupled with the prior art inner shroud 225. In FIG. 3B, the inner trunnion 306 is disposed within the inner shroud 225. In FIG. 3B, the trunnion 306 is retained in the shroud 225 by the retainer 310, and the shroud retaining features 314. In such examples, the retainer 310 retains the VSV 203 during the operation of the compressor 112. In some examples, during operation of the compressor 112, the thermal condition and/or vibrational response of the VSV 203 and/or compressor 112 can cause the trunnion 306 to deform in a manner that prevents the VSV 203 from rotating about the axis 312. For example, the trunnion 306 can elastically deform such that the three or more points of the trunnion 306 contact the retaining features 314, which inhibits (e.g., prevents, etc.) the trunnion 306 from rotating within the shroud 225. This response decreases the efficiency of the gas turbine 100 and subjects the shroud assembly and/or VSV 203 to a comparatively large amount of stress, which can cause the trunnion 306 to crack and/or prematurely fatigue. The locking of the VSV 203 can increase the amount of bending stress imparted on the outer trunnion 302, further fatiguing the VSV 203 and the shrouds 223, 225.

The following examples refer to a gas turbine engine and VSVs, similar to the engine described with reference to FIG. 1 and the VSVs of FIGS. 2-3B, except that the VSVs have been modified to include anti-lock trunnions, in accordance with this disclosure. When the same element number is used in connection with FIGS. 4A-7 as was used in FIGS. 1-3B, it has the same meaning unless indicated otherwise.

Figure 4A:
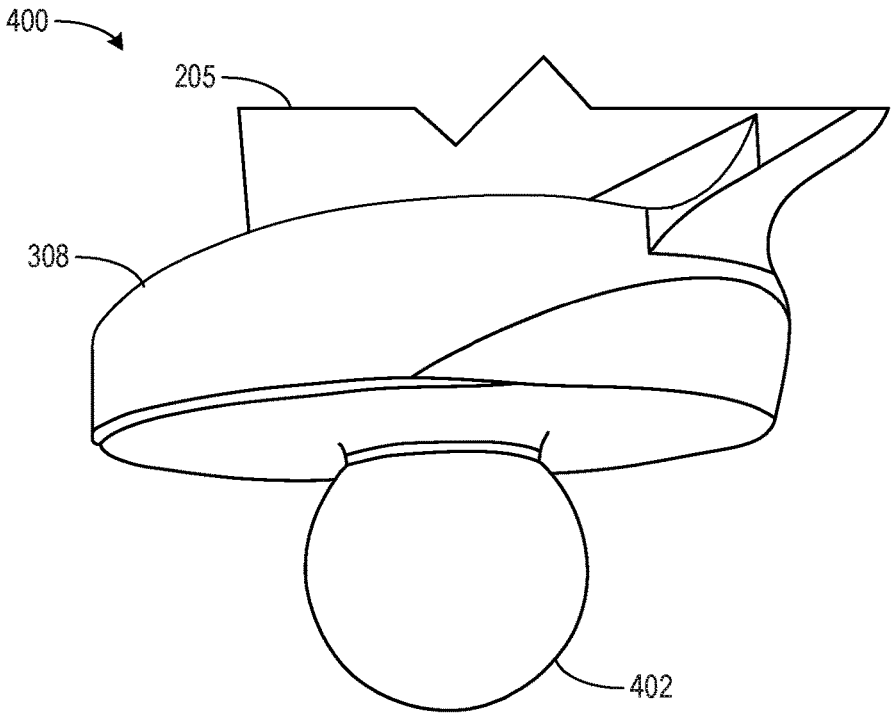
FIG. 4A is a front view of a VSV with a spherical trunnion.

FIG. 4A is a front view of a VSV 400 with a spherical trunnion 402. The VSV 400 is able to rotate about the rotational axis 312 due the symmetry of the spherical trunnion 402 about the rotational axis 312. In the illustrated example of FIG. 4A, the spherical trunnion 402 is substantially spherical. That is, the spherical radius of the trunnion 402 does not vary along the radius of the spherical trunnion 402 by more than a threshold amount (e.g., 25%, etc.). In the example of FIG. 4A, the spherical trunnion is a spherical extrusion from the platform 308. As such, the top of the spherical trunnion 402 (e.g., the portion of the spherical trunnion 402 furthest from the center of the compressor 114 along the radial axis, etc.) is generally planar (e.g., flat, etc.). As such, the top portion of the spherical trunnion 402 is not completely spherical. In FIG. 4A, the spherical trunnion 402, the platform 308, and the stator airfoil 205 are a unitary part. In such examples, the VSV 400 can be manufactured via additive manufacturing. Additionally or alternatively, the VSV 400 can be composed of any number of distinct parts and manufactured by any suitable manufacturing method or combination thereof. In some examples, the trunnion 402 is solid. In other examples, the trunnion 402 is hollow.

The spherical shape of the trunnion 402 prevents the trunnion 402 from deforming in a manner that locks the rotation of the VSV 400. Particularly, the trunnion 402 does not form three points of contact with the shroud 223 due to thermal conditions and/or vibrational responses during operation of the compressor 114. In some examples, due to the lower volume of sphere compared to a cylinder with an equal radius and the lack of a retainer (e.g., the retainer 310 of FIG. 3B, etc.), the spherical trunnion 402 has a lower mass than the trunnion 402 of FIG. 4. As such, gas turbines including VSVs with spherical trunnions (e.g., the VSV 400, etc.) have a lower mass when compared to gas turbines with prior art trunnions.

Figure 4B:
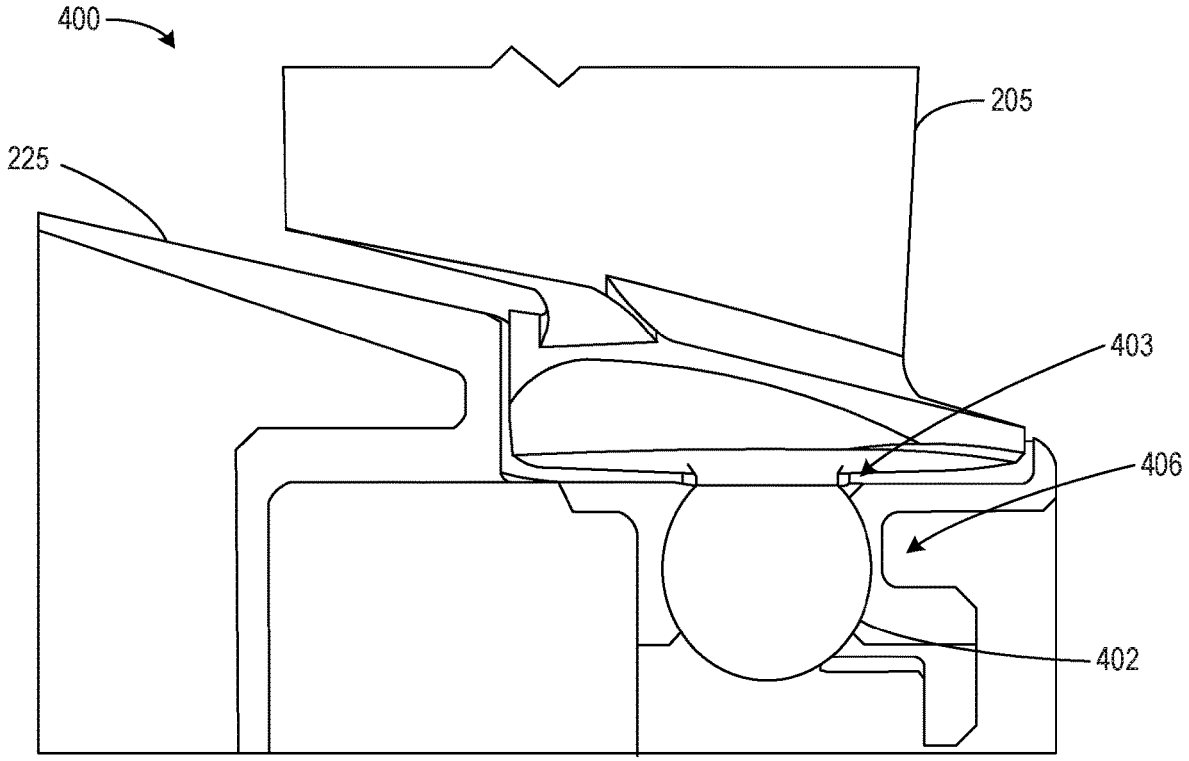
FIG. 4B is a cross-sectional view of the VSV of FIG. 4A.

FIG. 4B is a cross-sectional view of the VSV 400 of FIG. 4A. In the illustrated example of FIG. 4A, due to the spherical shape of the trunnion 402, the spherical trunnion 402 does not include a retainer lip. That is, in the cross-sectional view of FIG. 4A, the spherical shape of the trunnion 402 is radially wider within the shroud 225 than the interface between the VSV 400 and shroud 225 (e.g., the opening 403 of FIG. 4B, etc.). In some examples, contact between the shroud 225 and trunnion 402 enables the trunnion 402 to act as a frictional damper. As such, the spherical trunnion 402 dissipates vibrational energy generated during the operation of the engine. Accordingly, in some examples, the spherical trunnion 402 improves the vibrational response of the VSV 400 by damping the vibration of the VSV 400. In FIG. 4B, the spherical trunnion 402 is retained by a shroud ring 406.

Figure 5:
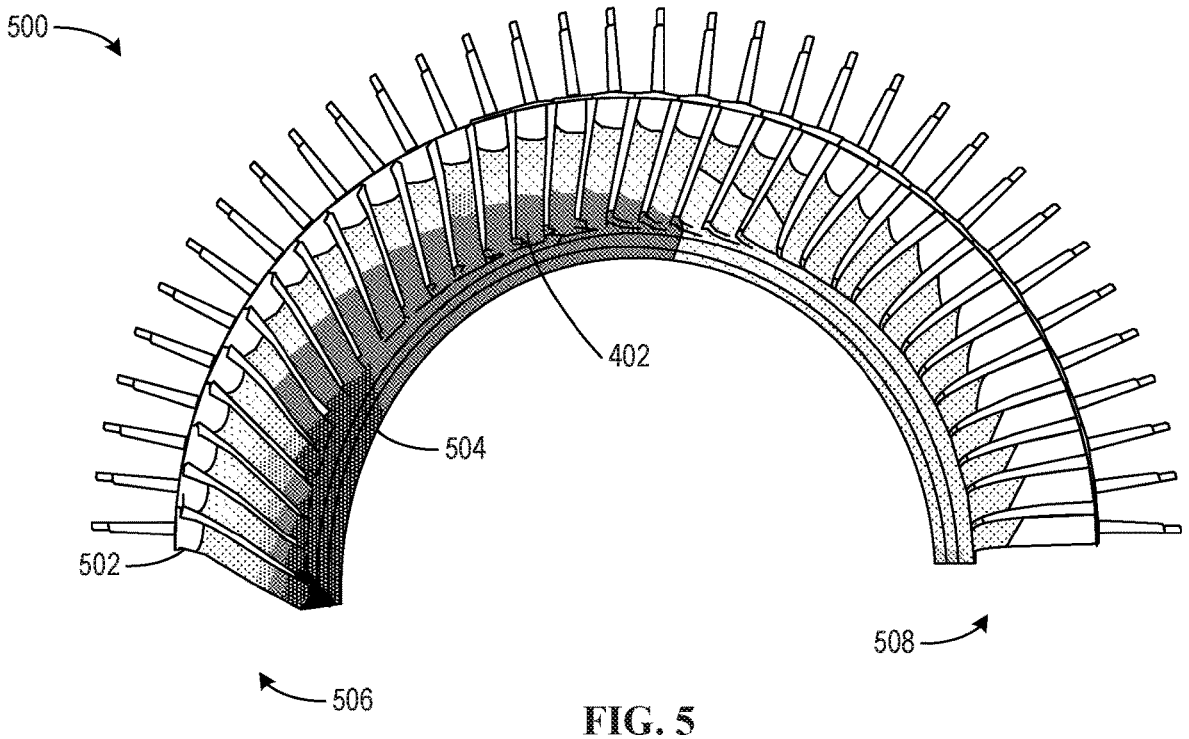
FIG. 5 is a perspective view of a VSV and shroud assembly including the VSV of FIGS. 4A and 4B.

FIG. 5 is a perspective view of a shroud assembly 500 including the VSV 400 of FIGS. 4A and 4B. In FIG. 5, the shroud assembly 500 includes an outer shroud ring 502, an inner shroud ring 504, and a plurality of VSVs, including the VSV 400 of FIG. 4A. The example shroud assembly 500 is configured to be coupled to another shroud assembly at ends 506, 508 (e.g. via one or more fasteners, a weld, etc.) to form a stator row of a compressor (e.g., the compressor 112 of FIG. 1, etc.). In prior art examples, in the event of VSV lock, the ends 506, 508 experience relatively high amounts of stress and strain (e.g., when compared to the rest of the shroud assembly 500, etc.), which can lead to part fatigue and cracking. In the illustrated example of FIG. 5, relatively darker areas of the shroud assembly 500 correspond to areas of relatively higher stress and strain. To remedy such stress and strain, the shroud assembly 500 includes a plurality of VSVs with spherical trunnions (e.g., the VSV 400 with spherical trunnion 402 of FIGS. 4A and 4B, etc.) to reduce stress and strain experiences. While the shroud assembly 500 of FIG. 5 is depicted as a half-circle, the shroud assembly 500 can, in other examples, be any suitable portion of the stator row (e.g., a fourth of the stator row, a third of the stator row, etc.). In such examples, the stator row can include a corresponding quantity of shroud assemblies (e.g., 3 parts, 4 parts, etc.). In some such examples, spherical trunnion VSVs 400 reduce the stress experienced at the corresponding coupling points of the shroud assemblies.

Figure 6:
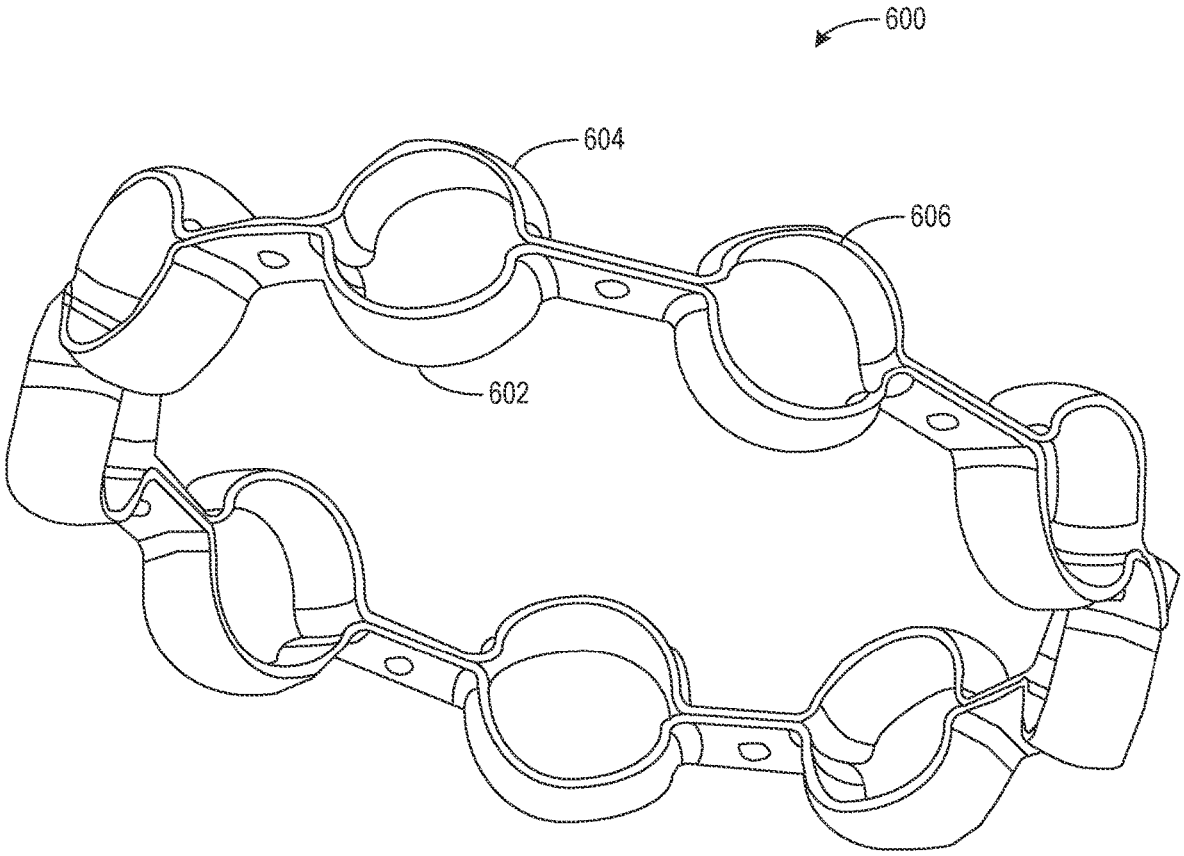
FIG. 6 is a perspective view of a shroud ring to receive the spherical trunnion of the VSV of FIGS. 4A and 4B.

FIG. 6 is a perspective view of a trunnion ring 600 to receive the spherical trunnion 402 of the VSV 400 of FIGS. 4A and 4B. The trunnion ring 600 can be used to implement the trunnion ring 406 of FIG. 4B. In the illustrated example of FIG. 6, the trunnion ring 600 includes a first component 602 and a component 604, which are coupled to together to form the ring 600 (e.g., via one or more fasteners, welds, etc.). In FIG. 6, the ring 600 includes a plurality of openings, including a first opening 606. The opening 606 is shaped to contain and retain the spherical trunnion 402. In some examples, contact between the walls of the opening 606 and the spherical trunnion 402 frictional damps vibrations (e.g., vibrations generated during the operation of the gas turbine 100 of FIG. 1, etc.). In some examples, the trunnion ring 600 can be a component of the inner shroud ring 504.

Figure 7:
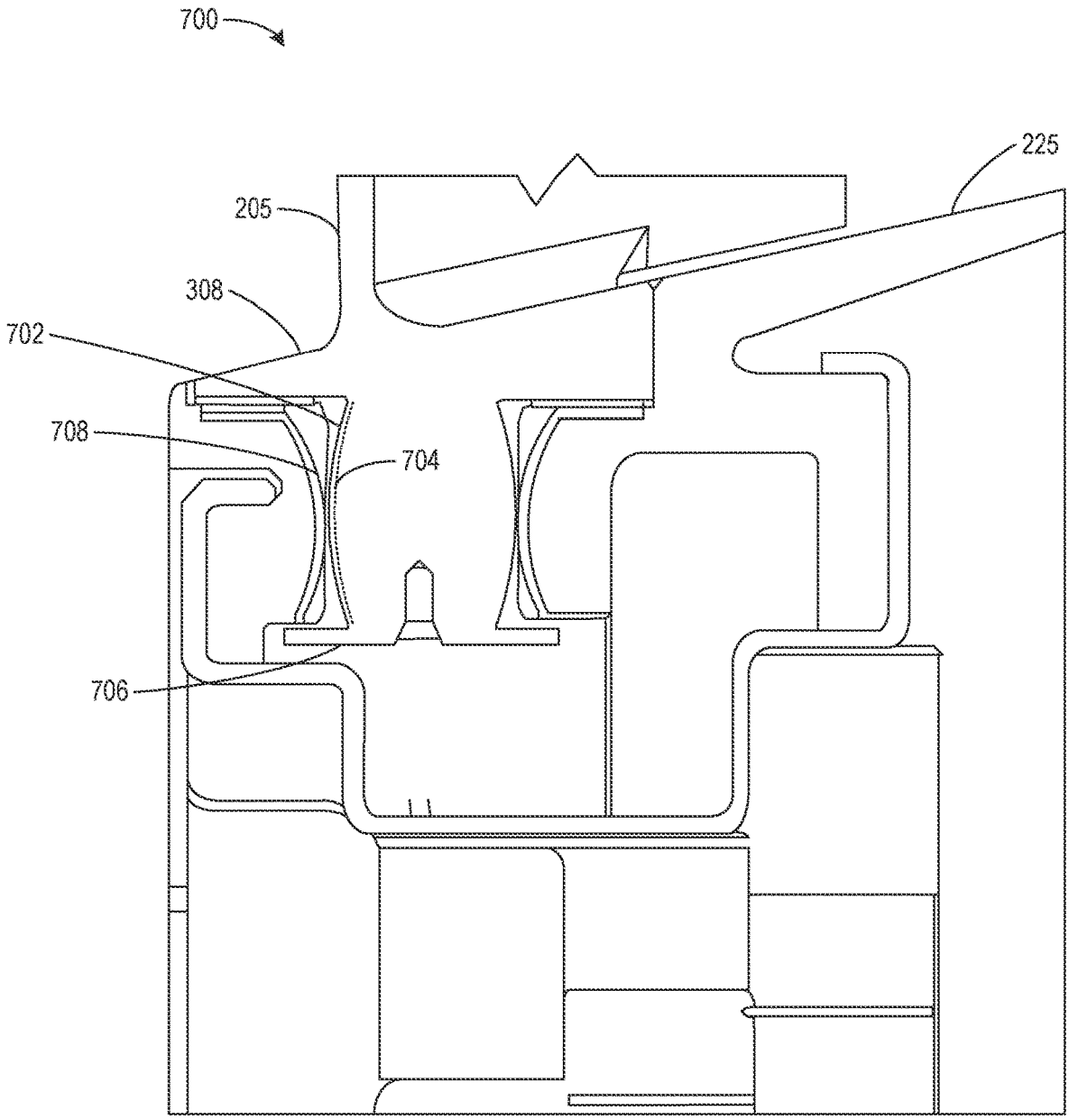
FIG. 7 is a cross-sectional view of an alternative VSV including a trunnion with a curved surface.

FIG. 7 is a cross-sectional view of an alternative VSV 700 including a trunnion 702 with a curved surface 704. The curved surface 704 extends between the inner platform 308 and a retainer 706 at the radially innermost portion of the trunnion 702. In FIG. 7, a curved surface 706 has a convex elliptical profile (e.g., an ovoid profile, etc.). In other examples, the trunnion 702 can have any other suitable profile (e.g., a circular profile, a parabolic profile, a hyperbolic profile, generally an open curved profile, etc.). In other examples, the curved surface 704 is concave. The curved surface 704 is curved in the axial-radial plane (e.g., a plane defined by the radial direction and axial direction of a gas turbine, etc.). As such, the trunnion 702 has a generally ellipsoidal shape with substantially planar ends, namely, the retainer 706 and the platform 304. That is, the trunnion 702 has a semi-spherical shape. Additionally or alternatively, the trunnion 702 can have any other suitable shape (e.g., a hyperboloidal shape, etc.). In FIG. 7, the trunnion 702, the retainer 706, the platform 304, and the stator airfoil 205 are a unitary part. In such examples, the trunnion 702, the retainer 706, the platform 304, and the stator airfoil 205 can be manufactured via additive manufacturing. In other examples, the VSV 700 is formed from a plurality of parts. The VSV 700 and/or the trunnion 702 can be composed of any suitable material or combination thereof (e.g., aluminum, titanium, a titanium alloy, a nickel alloy, a composite, etc.)

Like the spherical trunnion 402 of FIGS. 4A and 4B, the trunnion 702 is shaped to prevent the trunnion 702 from deforming such that the trunnion 702 would lock the rotations of the VSV 700. Particularly, the trunnion 702 does not form three points of contact with the inner shroud 225 when subjected to a vibrational and/or thermal response of the VSV 700. In some examples, contact between the shroud 225 and the trunnion 702 frictional damps vibrations within the shroud 225 and/or trunnion 702. As such, the trunnion 702 dissipates vibrational energy generated during the operation of the engine. Accordingly, in some examples, the trunnion 702 improves the vibrational response of the VSV 700. Further aspects of the invention are provided by the subject matter of the following clauses:

Further aspects of the invention are provided by the subject matter of the following clauses:

1. An apparatus comprising an airfoil to be disposed within a flow path of a gas turbine engine, the gas turbine engine defining an axial axis, a radial axis and a circumferential axis, an outer trunnion, and an inner trunnion including a curved surface in an axial-radial plane, the inner trunnion enabling the airfoil to be rotatably mounted to an inner shroud of the gas turbine engine.

2. The apparatus of any preceding clause wherein the airfoil, the outer trunnion, and the inner trunnion are a monolithic unit.

3. The apparatus of any preceding clause wherein the inner trunnion has a substantially spherical shape.

4. The apparatus of any preceding clause wherein the substantially spherical shape enables the inner trunnion to be retained within the inner shroud without a retainer.

5. The apparatus of any preceding clause wherein the inner trunnion includes a centerline, the curved surface having a convex profile relative to the centerline.

6. The apparatus of any preceding clause further including a retainer to retain the inner trunnion within the inner shroud.

7. The apparatus of any preceding clause wherein the curved surface of the inner trunnion prevents vibration-induced locking of a rotation of the airfoil about the radial axis.

8. An apparatus to be coupled within a gas turbine engine, the gas turbine engine defining an axial axis, a radial axis and a circumferential axis, the apparatus comprising an inner shroud segment, an outer shroud segment, a plurality of variable stator vanes (VSVs) extending between the inner shroud segment and the outer shroud segment, a first VSV of the plurality of VSVs including an airfoil, an outer trunnion mounted within the outer shroud segment, and an inner trunnion mounted within the inner shroud segment, the inner trunnion including a curved surface in an axial-radial plane, the inner trunnion enabling the airfoil to be rotatably mounted to the inner shroud segment.

9. The apparatus of any preceding clause wherein the inner shroud segment is a first inner shroud segment and the outer shroud segment is a first outer shroud segment, the apparatus further including a second inner shroud segment, a second outer shroud segment, and a fastener to couple at least one of (1) the first inner shroud segment to the inner second shroud segment or (2) the first outer shroud segment to the second outer shroud segment.

10. The apparatus of any preceding clause wherein the first inner shroud segment and the first outer shroud segment define substantially one half of a cross-section of a flow path of the gas turbine engine.

11. The apparatus of any preceding clause wherein the curved surface of the inner trunnion releases rotation of at least one of (1) the first inner shroud segment relative to the second inner shroud segment or the (1) the first outer shroud segment relative to the second outer shroud segment.

12. The apparatus of any preceding clause wherein the inner trunnion has a substantially spherical shape.

13. The apparatus of any preceding clause wherein the inner trunnion includes a centerline, the curved surface having a convex profile relative to the centerline.

14. A gas turbine engine defining an axial axis, a radial axis and a circumferential axis, the gas turbine engine including an inner shroud, an airfoil to be disposed within a flow path of the gas turbine engine, an outer trunnion disposed at a top edge of the airfoil, and an inner trunnion including a curved surface in an axial-radial plane, the inner trunnion enabling the airfoil to be rotatably mounted to the inner shroud.

15. The gas turbine engine of any preceding clause wherein the airfoil, the outer trunnion, and the inner trunnion are a monolithic unit.

16. The gas turbine engine of any preceding clause wherein the inner trunnion has a substantially spherical shape.

17. The gas turbine engine of any preceding clause wherein the substantially spherical shape enables the inner trunnion to be retained within the inner shroud without a retainer.

18. The gas turbine engine of any preceding clause wherein the inner trunnion includes a centerline, the curved surface having a convex profile relative to the centerline.

19. The gas turbine engine of any preceding clause further including a retainer to retain the inner trunnion within the inner shroud.

20. The gas turbine engine of any preceding clause wherein the curved surface of the inner trunnion prevents vibration-induced locking of a rotation of the airfoil about the radial axis.

The following claims are hereby incorporated into this Detailed Description by this reference, with each claim standing on its own as a separate embodiment of the present disclosure.

What is claimed is:

1. An apparatus comprising:

an airfoil to be disposed within a flow path of a gas turbine engine, the gas turbine engine defining an axial axis, a radial axis and a circumferential axis;

an outer trunnion; and an inner trunnion including a curved surface in an axial-radial plane, the inner trunnion enabling the airfoil to be rotatably mounted to an inner shroud of the gas turbine engine via an opening of a trunnion ring, the trunnion ring including a first component and a second component coupled together via a fastener to form the opening.

2. The apparatus of claim 1, wherein the airfoil, the outer trunnion, and the inner trunnion are a monolithic unit.

3. The apparatus of claim 1, wherein the inner trunnion has a substantially spherical shape.

4. The apparatus of claim 3, wherein the substantially spherical shape enables the inner trunnion to be retained within the inner shroud without a retainer.

5. The apparatus of claim 1, wherein the inner trunnion includes a centerline, the curved surface having a convex profile relative to the centerline.

6. The apparatus of claim 5, further including a retainer to retain the inner trunnion within the inner shroud.

7. The apparatus of claim 1, wherein the curved surface of the inner trunnion prevents vibration-induced locking of a rotation of the airfoil about the radial axis.

8. An apparatus to be coupled within a gas turbine engine, the gas turbine engine defining an axial axis, a radial axis and a circumferential axis, the apparatus comprising:

an inner shroud segment;

an outer shroud segment;

a plurality of variable stator vanes (VSVs) extending between the inner shroud segment and the outer shroud segment, a first VSV of the plurality of VSVs including:

an airfoil;

an outer trunnion mounted within the outer shroud segment; and an inner trunnion mounted within the inner shroud segment, the inner trunnion including a curved surface in an axial-radial plane, the inner trunnion enabling the airfoil to be rotatably mounted to the inner shroud segment via an opening of a trunnion ring, the trunnion ring including a first component and a second component coupled together via a fastener to form the opening.

9. The apparatus of claim 8, wherein the inner shroud segment is a first inner shroud segment and the outer shroud segment is a first outer shroud segment, the apparatus further including:

a second inner shroud segment;

a second outer shroud segment; and a fastener to couple at least one of (1) the first inner shroud segment to the second inner shroud segment or (2) the first outer shroud segment to the second outer shroud segment.

10. The apparatus of claim 9, wherein the first inner shroud segment and the first outer shroud segment define one half of a cross-section of a flow path of the gas turbine engine.

11. The apparatus of claim 10, wherein the curved surface of the inner trunnion releases rotation of at least one of (1) the first inner shroud segment relative to the second inner shroud segment or the (1) the first outer shroud segment relative to the second outer shroud segment.

12. The apparatus of claim 8, wherein the inner trunnion has a substantially spherical shape.

13. The apparatus of claim 8, wherein the inner trunnion includes a centerline, the curved surface having a convex profile relative to the centerline.

14. A gas turbine engine defining an axial axis, a radial axis and a circumferential axis, the gas turbine engine including:

an inner shroud including a trunnion ring, the trunnion ring including a first component and a second component coupled together via a fastener to form an opening;

an airfoil to be disposed within a flow path of the gas turbine engine;

an outer trunnion disposed at a top edge of the airfoil; and an inner trunnion including a curved surface in an axial-radial plane, the inner trunnion enabling the airfoil to be rotatably mounted to the inner shroud via the opening of the trunnion ring.

15. The gas turbine engine of claim 14, wherein the airfoil, the outer trunnion, and the inner trunnion are a monolithic unit.

16. The gas turbine engine of claim 14, wherein the inner trunnion has a substantially spherical shape.

17. The gas turbine engine of claim 16, wherein the substantially spherical shape enables the inner trunnion to be retained within the inner shroud without a retainer.

18. The gas turbine engine of claim 14, wherein the inner trunnion includes a centerline, the curved surface having a convex profile relative to the centerline.

19. The gas turbine engine of claim 18, further including a retainer to retain the inner trunnion within the inner shroud.

20. The gas turbine engine of claim 14, wherein the curved surface of the inner trunnion prevents vibration-induced locking of a rotation of the airfoil about the radial axis.

* * * * *